United States Patent [19]

Gittings

[11] 4,339,136

[45] Jul. 13, 1982

[54] BOARD GAME HAVING TRIANGULAR PLAYING SPACES

[76] Inventor: Neil A. Gittings, 7320 Red Ledge Dr., Scottsdale, Ariz. 85253

[21] Appl. No.: 223,276

[22] Filed: Jan. 8, 1981

[51] Int. Cl.[3] ..... A63F 3/00

[52] U.S. Cl. ..... 273/242; 273/241; 273/260; D21/34

[58] Field of Search ..... 273/236, 241, 242, 243, 273/258, 260, 261, 262; D21/24, 34, 14; D25/13

[56] References Cited

U.S. PATENT DOCUMENTS

| | | | |
|---|---|---|---|
| D. 30,395 | 3/1899 | Breitenbach | 273/264 X |
| 384,195 | 6/1888 | Duryea | 273/258 |
| 2,978,074 | 4/1961 | Schmidt | D25/13 X |
| 4,213,615 | 7/1980 | Price | 273/260 |

FOREIGN PATENT DOCUMENTS

| | | | |
|---|---|---|---|
| 433825 | 9/1926 | Fed. Rep. of Germany | 273/242 |

*Primary Examiner*—Richard C. Pinkham
*Assistant Examiner*—Scott L. Brown
*Attorney, Agent, or Firm*—Harvey B. Jacobson

[57] ABSTRACT

A board game including a playing board having a plurality of triangular spaces delineated thereon with the spaces being arranged in concentric rows with the triangular spaces in each row being alternately arranged with the triangles having two distinctive colors and arranged to represent a geodesic dome and either 2-dimensional or 3-dimensional. Playing pieces representive of geometric shapes are provided including two sets of playing pieces of distinguishable color to enable opponents to play a game. Each set of playing pieces includes one square, three circles and three triangles in which the square playing piece can move three triangular spaces at a time, the circle can move two triangular spaces at a time and the triangle can move only one triangular space at a time with the object of the game being to block your opponents square game piece from any further movement.

2 Claims, 6 Drawing Figures

BOARD GAME HAVING TRIANGULAR PLAYING SPACES

BACKGROUND OF THE INVENTION

1. Field of the Invention

The present invention relates to a board-type game including a playing surface which may be either 2-dimensional or 3-dimensional, having distinguiably colored triangular spaces delineated thereon representing a geodesic dome together with game pieces positionable on the game board in a particular pattern when starting a game and movable in accordance with particular rules of play for playing a game.

2. Description of the Prior Art

Board-type games of various types are generally well known with such games normally employing a game board having a planar upper surface with spaces delineated thereon for receiving game pieces which are moved in a particular manner in playing a game. The following U.S. patents are exemplary of the development in this field of endeavor:

| | |
|---|---|
| 463,602 | November 17, 1891 |
| 1,161,649 | November 23, 1915 |
| 3,455,556 | July 15, 1969 |
| 3,761,093 | September 25, 1973 |
| 3,998,463 | December 21, 1976 |
| 4,150,828 | April 24, 1979 |

SUMMARY OF THE INVENTION

An object of the present invention is to provide a board game utilizing a board having triangular spaces delineated thereon oriented in a generally square pattern of concentric rows of alternating color triangular spaces representative of a geodesic dome and forming a playing field or surface for playing a game.

Another object of the invention is to provide a board game in accordance with the preceding object together with a plurality of game pieces with the game pieces being arranged in sets of different colors for distinguishment and being of geometric shapes having different movement capabilities in order to play a game in accordance with particular rules of play.

Yet another object of the invention is to provide a board game in accordance with the preceding objects which is capable of being constructed in a 2-dimensional embodiment or a 3-dimensional embodiment with the geometric shape and names of the game pieces being abstractly indicative of the movement capabilities of the individual pieces along the surface of the game board.

Still another object of the invention is to provide a board game in accordance with the preceding objects which is single in construction, entertaining and educational in use and effective for use in playing various games.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Referring now specifically to the drawings, the board game of the present invention includes a game board generally designated by numerall 10 which includes a generally square member 12 having a generally planar upper surface 14 with the member 12 being in the form of a generally rigid panel of heavy cardboard, wood, plastic, metal or other material. If desired, the game board 10 can be provided with a central hinge to enable it to be folded into two overlapping portions for more convenient storage if desired with the hinge being a conventional tape hinge or the like.

Figure 1:
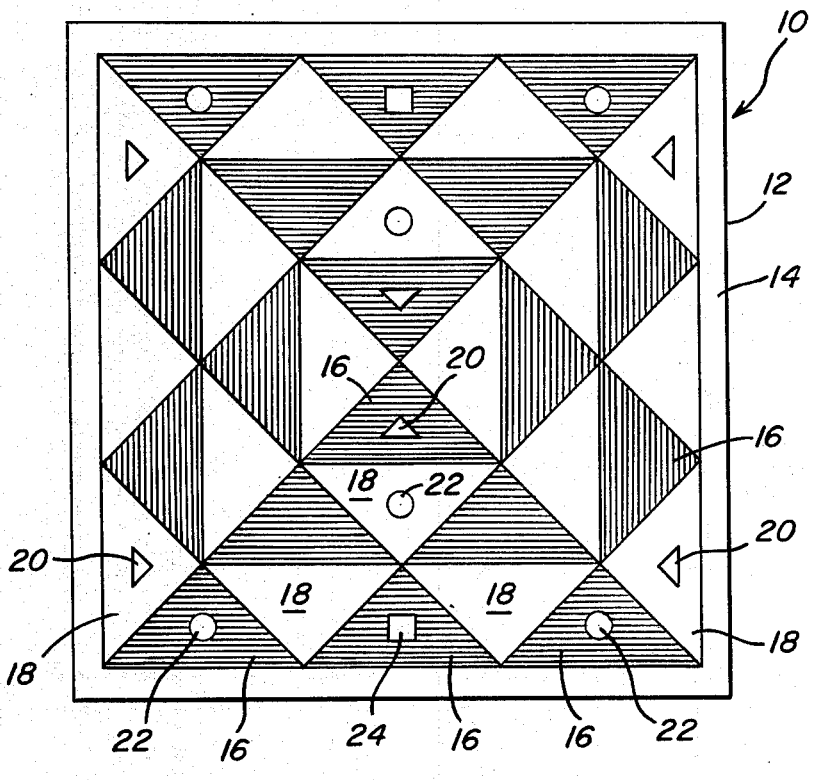
FIG. 1 is a top plan view of the game board with the game pieces positioned thereon in a position to start a game with the triangular spaces on the game board being representative of a geodesic dome.

The upper surface 14 of the member 12 is substantially planar and divided into a plurality of distinctively colored triangular spaces 16 and 18 with the spaces 16 being black and the spaces 18 white or other distinguishable colors may be used such as red and white, black and red or the like. The triangular spaces 16 and 18 are oriented in concentric circular arrangements around the periphery of the surface 14 as illustrated in FIG. 1 with the triangles having their bases outermost on two opposed sides of the board having three triangular spaces 16 in adjacent relation, that is, with their bases being continuous with two inverted white triangular spaces 18 interposed therebetween whereas the other two opposed sides of the game board has three white triangular spaces 18 in contiguous relationship which are separated by two inverted triangular black spaces 16. Thus, each concentric row of spaces includes alternating triangular spaces in which the equal sides of all triangles contact the side of a different colored triangular space and the sides of the triangular spaces form the path of movement for game pieces which are moved from one triangular space to an adjacent triangular space with the game pieces not passing over the corners or apices of the triangular spaces.

Figure 3:
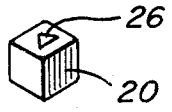
FIGS. 3–5 are perspective views illustrating the three types and shapes of game pieces employed on the game board.
Figure 4:
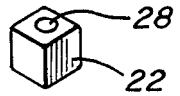
Figure 5:
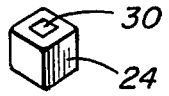
Figure 2:
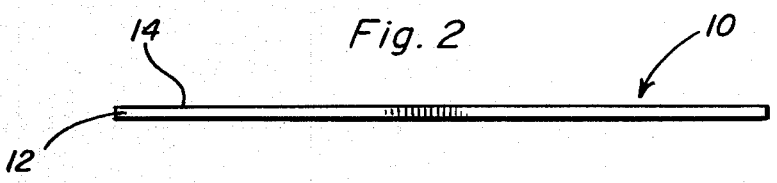
FIG. 2 is a side elevational view of FIG. 1 with the game pieces removed illustrating the 2-dimensional construction of this embodiment of the game board.

FIGS. 3, 4 and 5 illustrate game pieces in the form of blocks 20, 22 and 24 in the form of cubes having on at least one surface thereof, indicia illustrating geometrical shapes such as a triangle 26, a circle 28 and a square 30 with it being pointed out that the shapes of the blocks may actually be triangular, circular or square. The game will include two sets of playing pieces, one for each player, with the sets being distinguishably colored to enable the players to determine their own playing pieces. Each set of playing pieces includes one square playing piece 24, three circular playing pieces 22 and three triangular playing pieces 20.

FIG. 1 illustrates the positioning of the playing pieces on the game board 10 in order to start a game. The square, circular and triangular game pieces are illustrated as actual geometric shapes for clarity with the two opponents occupying opposite sides of the game board. The three triangular spaces 16 on opposite sides of the game board include two of the circular game pieces 22 and the square game piece 24 thereon with the square game piece being placed in the central space 16 and the two circular game pieces positioned on the respective outermost spaces 16. The third circular game piece 28 is positioned in the inverted triangular space 18 in the second concentric row of triangular spaces, that is, directly in alignment with the square game piece 24 and radially in alignment with the center of the game board. One of the triangular game pieces 20 is positioned in the triangular space 16 having its apex coinciding with the center of the game board and being in the innermost concentric row of triangular spaces with the apex thereof directed toward the apex of the triangular space 16 on which it is positioned. The other two triangular game pieces 20 are positioned on the triangular spaces 18 which are contiguous with the outermost spaces 16 having the circular game pieces 22 positioned thereon with the apices of the triangular game pieces 20 facing inwardly, that is, toward the apex of the triangular space 18 on which it is positioned.

Figure 6:
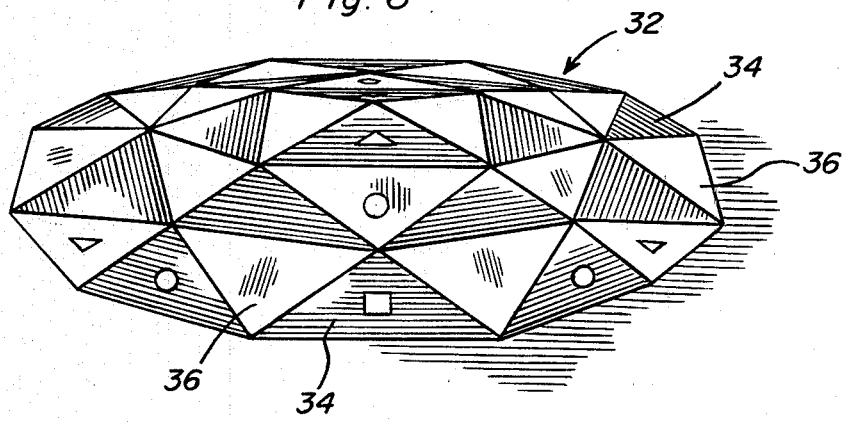
FIG. 6 is a perspective view of the 3-dimensional game board embodiment of the present invention.

The game board may be 3-dimensional, generally in the shape of a geodesic dome as designated by numeral 32 in FIG. 6 with the triangular spaces 34 and 36 thereon being distinguishably colored and arranged in the same manner as the triangular spaces 16 and 18 in FIG. 1. The game pieces are illustrated on FIG. 6 in the same relationship as in FIG. 1 with the game pieces illustrated therein being actual geometric shapes and oriented in the same relationship to the layout of the triangular spaces which are associated with each other in a manner to form a shallow dome-shaped configuration. Any suitable means may be provided for retaining the game pieces in position on the 3-dimensional game board while playing a game. For example, the game board may have a ferrous sheet or surface associated therewith and the game pieces may have a magnet associated therewith to retain the game pieces on the inclined triangular surfaces.

The game board, either two or three dimensional defines a playing field of 36 triangular spaces to represent a geodesic dome with the game utilizing three basic geometric shapes which have been named to abstractly suggest their individual movement capabilities. The playing pieces or game pieces are arranged on the game board in such a configuration that it is strategically beneficial for the beginning of the game and beneficial in learning the game. When the game pieces are positioned as illustrated in FIG. 1, they actually constitute three groups of one triangle and one circle with the square in the center of these groups with the circle adjacent the square and the triangles remote therefrom.

The triangular game piece can move only one triangular space at a time, the circular game piece can move two triangular spaces at a time and the square game piece can move three triangular spaces at a time. The triangle is called the "Geodesic" which term applies or means the shortest distance between two points. Thus, the triangular game piece moves only one space. The circular game piece is called "Continuum". This game piece moves two spaces and will always remain on the color it begins on and therefore the circular game pieces are considered to be continuous. The square game pieces is called "Powerblock" with the four points of the square representing the four basic moves of this piece which are classified according to the shapes that are formed when this piece moves three spaces. The square game piece will always move only three spaces but there are four ways in which it can move and its name suggests the ultimate goal of the game, that is to block your opponent's square game piece. The object of the game is to attack your opponent's square game piece and when your opponent's square game piece cannot move, that is, all of its potential moves are blocked, the game is over.

When playing the game, the game pieces cannot jump in any way, not even over your own game pieces. Each game piece must move the full extent of its capabilities during each play or it may not move at all. The game pieces may not move over the corners of the triangular spaces with the only path of movement of the game pieces being over the sides of the triangular spaces. The square game piece or "Powerblock" cannot move into a position of jeopardy. For example, it may not move within one triangular space of the triangular game piece or "Geodesic".

The game may be played on either the 2-dimensional or 3-dimensional board and the game may be varied by increasing the number of triangular spaces if desired and various types of rules of play may be provided. Primarily, the players should protect themselves by not blocking their own pieces while at the same time trying to block the opponent's game pieces in a manner that the opponent will not be able to move his "Powerblock" or square game piece 24 which ends the game.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A board game comprising a game board with a playing field having a plurality of triangular spaces of two distinguishable colors delineated thereon and arranged in concentric rows, all adjacent triangular spaces being distinguishably colored, all of the spaces having the same shape and dimensional characteristics, the apices of the innermost row of triangular spaces being disposed inwardly and in contacting relation to form the center of the playing field with only two intersecting lines passing through the center of the playing field, the innermost row of spaces comprising only four triangular spaces, the outer rows of triangular spaces having adjacent spaces inverted in relation to each other, a plurality of game pieces positionable on and movable along the triangular spaces, said game pieces being divided into two sets which are distinguishably colored with each set including a game piece designated as a square, three game pieces designated as a triangle and three game pieces designated as a circle, the game pieces designated as a triangle capable of moving one space, the game pieces designated as a circle capable of moving two spaces and the game piece designated as a square capable of moving three spaces with the object of the game being to block movement of the opponent's game piece designated as a square in which none of the pieces can jump each other and the game pieces must move their full capability during each turn of movement.

2. The structure as defined in claim 1 wherein said game pieces have indicia thereon illustrating the designated geometric shape.

* * * * *